US011255142B2

(12) United States Patent
Taubner

(10) Patent No.: US 11,255,142 B2
(45) Date of Patent: Feb. 22, 2022

(54) SYSTEMS AND METHODS FOR DETECTING STEPS IN TUBULAR CONNECTION PROCESSES

(71) Applicant: NOETIC TECHNOLOGIES INC., Edmonton (CA)

(72) Inventor: Spencer P. Taubner, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 0 days.

(21) Appl. No.: 17/262,716

(22) PCT Filed: Aug. 13, 2020

(86) PCT No.: PCT/CA2020/000101
§ 371 (c)(1),
(2) Date: Jan. 23, 2021

(87) PCT Pub. No.: WO2021/026632
PCT Pub. Date: Feb. 18, 2021

(65) Prior Publication Data

US 2021/0262300 A1 Aug. 26, 2021

Related U.S. Application Data

(60) Provisional application No. 62/886,026, filed on Aug. 13, 2019.

(51) Int. Cl.
*E21B 19/16* (2006.01)

(52) U.S. Cl.
CPC ..... *E21B 19/166* (2013.01)

(58) Field of Classification Search
CPC ..... E21B 19/165; E21B 19/166
See application file for complete search history.

(56) References Cited

U.S. PATENT DOCUMENTS 4,592,125 A * 6/1986 Skene ..... E21B 19/166 29/407.03
6,212,763 B1 * 4/2001 Newman ..... B25B 21/002 173/180

(Continued)

FOREIGN PATENT DOCUMENTS

WO 2018038963 A1 3/2018
WO 2018058214 A1 4/2018
WO 2019119107 A1 6/2019

OTHER PUBLICATIONS

International Search Report re PCT/CA2020/000101, issued by the ISA/CA dated Oct. 28, 2020.

(Continued)

*Primary Examiner* — Shane Bomar
(74) *Attorney, Agent, or Firm* — Donald V. Tomkins

(57) ABSTRACT

In systems and methods for detecting steps in connection processes used in well operations using drilling rigs to manipulate tubular strings (such as drill strings and casing strings), sensor data gathered by data acquisition systems (such as electronic data recorders) associated with a drilling rig is analyzed to identify time intervals corresponding to specific steps constituting the complete connection process in question (such as connection make-up or connection break-out). These time intervals are compared against target or benchmark values for the corresponding process steps, thus facilitating identification of "invisible lost time" (ILT), determination of the causes of the ILT, and determination of appropriate measures to mitigate or eliminate the causes of the ILT. These systems and methods eliminate or minimize the need for onsite data collection by human observers using stopwatches or other manual data collection means.

38 Claims, 8 Drawing Sheets

(56) References Cited

U.S. PATENT DOCUMENTS

| | | | | |
|---|---|---|---|---|
| 7,031,840 | B1 | 4/2006 | Brett et al. | |
| 7,128,167 | B2 | 10/2006 | Dunlop et al. | |
| 9,792,571 | B1 | 10/2017 | Mandava et al. | |
| 2004/0144547 | A1* | 7/2004 | Koithan | E21B 21/02 166/380 |
| 2004/0154832 | A1* | 8/2004 | Koithan | E21B 47/00 175/26 |
| 2008/0060481 | A1* | 3/2008 | Hunter | E21B 19/165 81/57.11 |
| 2014/0116687 | A1 | 1/2014 | Ruehmann | |
| 2014/0246238 | A1* | 9/2014 | Abbassian | E21B 47/10 175/40 |
| 2014/0303894 | A1 | 10/2014 | Abbassian et al. | |
| 2015/0021016 | A1 | 1/2015 | Deng et al. | |
| 2015/0371344 | A1 | 12/2015 | Khare et al. | |
| 2017/0037691 | A1* | 2/2017 | Savage | E21B 21/08 |
| 2017/0204705 | A1 | 7/2017 | King | |
| 2017/0248000 | A1 | 8/2017 | Hundt et al. | |
| 2017/0328178 | A1 | 11/2017 | Lucas et al. | |
| 2018/0047117 | A1 | 2/2018 | Meehan | |
| 2018/0066517 | A1 | 3/2018 | Davila et al. | |
| 2018/0096277 | A1 | 4/2018 | Maidla et al. | |
| 2018/0216440 | A1 | 8/2018 | Gray et al. | |
| 2019/0004882 | A1* | 1/2019 | Martin | E21B 19/165 |
| 2020/0224525 | A1* | 7/2020 | Parmeshwar | E21B 17/006 |
| 2020/0355063 | A1* | 11/2020 | Van Vliet | E21B 47/07 |
| 2021/0115742 | A1* | 4/2021 | Agarwal | E21B 19/165 |

OTHER PUBLICATIONS

Written Opinion of the International Searching Authority re PCT/CA2020/100101, completed by the ISA/CA on Oct. 27, 2020, and issued by the ISA/CA dated Oct. 28, 2020.

OTC-28742-MS, "Application of Real-time Video Streaming and Analytics to Breakdown Rig Connection Process", paper presented at Offshore Technology Conference, Houston, Texas, Apr. 30 to May 3, 2018.

* cited by examiner

SYSTEMS AND METHODS FOR DETECTING STEPS IN TUBULAR CONNECTION PROCESSES

FIELD

The present disclosure relates in general to systems and methods for detecting discrete steps performed during connection make-up and break-out processes used for assembly or disassembly of tubular strings (such as drill strings and casing strings for oil and gas wells), for purposes of identifying process inefficiencies, particularly but not exclusively in association with well operations using "top drive" drilling rigs.

BACKGROUND

Operations related to the construction, maintenance, and abandonment of wells commonly involve the use of drilling rigs to manipulate tubular "strings" made up of tubular segments connected end-to-end by threaded connections. As used in this disclosure, the term "tubular" may be understood to mean any type of pipe, including pipe commonly known as casing, liner, tubing, drill pipe, or drill collars. Non-limiting examples of well operations involving strings of segmented tubulars include drilling operations, during which a borehole is formed by means of a rotating drill bit attached to a drill string, and casing running operations, during which a casing string is run into an existing borehole (for example, to provide the borehole with structural stability or to control the flow of fluids).

An individual tubular segment is referred to as a "joint". Once assembled in a well, a length of tubular segments is referred to as a "string". Sometimes, tubulars are pre-assembled into two-joint or three-joint units known as "stands" prior to a well operation to facilitate pipe handling. In this disclosure, the term "tubular element" is used to refer to either a single joint or a stand made up of multiple joints.

As used herein, the term "drilling rig" (or simply "rig") denotes apparatus incorporating equipment for hoisting, lowering, and rotating tubular elements and tubular strings, with said equipment including a "travelling block" (or simply "block"), which will be readily understood by persons skilled in the art. As used herein, the term "block height" refers to the height of the travelling block relative to a selected reference datum. The term "drilling rig" is to be understood as set out above notwithstanding that it might be used in the context of a well operation that does not involve actual drilling.

The process of connecting or disconnecting tubulars and associated pipe-handling activities (collectively referred to herein as the "connection process") can account for a significant portion of the time involved in a well operation. Considerable time savings can be realized by identifying and eliminating so-called "invisible lost time" in the connection process. As used in this disclosure, the term "invisible lost time" (or "ILT") refers to the difference between the time that was actually required to perform an operation and a preselected target or benchmark time for performing that operation. ILT can have numerous sources, including inadequate training of drilling rig personnel, issues with rig equipment, and environmental factors outside of human control (e.g., inclement weather). If ILT can be detected and its sources determined, then steps can be taken to address the underlying causes of the ILT and thereby to improve the efficiency of the well operation.

Detecting ILT in the connection process has historically required that rig personnel measure the duration of the connection process and its steps using manual means, such as a stopwatch. This has required that an additional person be deployed to the rig to conduct the measurements, often at significant cost, or that additional responsibility be assigned to existing rig personnel. Identifying ILT by manual means has not typically been feasible at larger scales (e.g., across numerous rigs).

To assist with the identification of ILT, a number of companies have developed automated rig state detection systems. These systems analyze data collected by sensors on a drilling rig and attempt to classify the rig state (e.g., drilling, reaming, or tripping) at each point in time. The amount of time spent in each rig state can then be calculated, allowing inefficiencies to be identified.

The way in which time associated with the connection process is reported can vary between systems; however, one commonly-used metric is the "slip-to-slip connection time". The "slips" are a component that is mounted in the rig floor and which can be selectively actuated or engaged to grip a tubular string passing therethrough, to support the weight of the tubular string (which would otherwise be supported by the hoisting system) during the connection process. The "slip-to-slip connection time" is the elapsed time between the engagement of the slips (which marks the start of the connection process) and the subsequent disengagement of the slips (which marks the end of the connection process). While the metric of slip-to-slip connection time is useful for overall optimization, it does not break down the connection process into smaller steps, and therefore is of minimal if any usefulness for purposes of pinpointing sources of ILT in the connection process.

Modern drilling rigs are commonly equipped with data acquisition systems known as electronic data recorders ("EDRs"). A typical EDR includes various sensors for measuring such parameters as the block height, the rotation rate of the top drive, and the torque applied by the top drive. However, EDR systems do not typically include a sensor for diagnosing or determining the slips state (i.e., whether the slips are engaged or disengaged). Therefore, to calculate slip-to-slip connection times, it is typically necessary to infer the slips state from one or more of the available sensor measurements.

One common method for determining the slips state is to compare the load on the hoisting system of the drilling rig (commonly referred to as the "hook load") to a specified value. If the measured hook load is close to the specified value, then it is assumed that the weight of the tubular string is supported by the slips (i.e., the slips are engaged). If the measured hook load is not close to the specified value, then it is assumed that the slips are disengaged and that the hoisting system is bearing the weight of the tubular string. The specified hook load value is typically equal to the block weight (i.e., the weight of the rig components supported by the hoisting system, such as the travelling block and the top drive) plus a tolerance to account for such things as the weight of a tubular element, friction in the hoisting system, and measurement error.

There are conditions under which this method does not accurately determine the slips state, leading to error in corresponding slip-to-slip connection times. For example, during well operations at shallow depths, the weight of the tubular string can be insufficient to reliably determine whether the hoisting system is supporting the tubular string based solely on the hook load. The same problem can occur during well operations involving light tubulars (e.g., smalldiameter and/or thin-wall tubing). Furthermore, it can be challenging to estimate the slips state during operations in deviated or horizontal wells. Frictional drag on the tubular string in such wells can require the driller to reduce the hook load significantly in order to advance the tubular string into the well, such that the hook loads measured with the slips engaged and with the slips disengaged are similar, thus complicating accurate determination of the slips state.

Recently, there have been efforts to identify ILT in the connection process using video cameras in combination with machine learning methods, an example of which is the approach described in "Application of Real-time Video Streaming and Analytics to Breakdown Rig Connection Process" (paper presented by Hegde, C., Awan, O., and Wiemers, T. at the Offshore Technology Conference in Houston, Tex., Apr. 30 to May 3, 2018). In this approach, one or more video cameras are positioned on the rig floor to record the actions of the crew. The video data is transmitted to image recognition software that attempts to classify the operation being performed by the crew at any given time.

This approach to identifying ILT has several significant challenges and limitations. First, the image recognition software must be "trained" to recognize the actions of the crew. This is accomplished by means of a training dataset, which consists of numerous images that have been manually classified by humans. The size of dataset required to train the image recognition software is large (e.g., 10,000 images or more), and the process of manually classifying images to create the training dataset is labour-intensive. In addition, the general applicability of this type of system is uncertain. For example, image recognition software that has been trained using a training dataset from one drilling rig might not be effective for classifying video data from a different drilling rig.

BRIEF SUMMARY OF THE DISCLOSURE

The present disclosure teaches embodiments of systems and methods for detecting one or more steps in the connection process in a well operation involving a tubular string. In this disclosure, references to "detecting" a step in the connection process are to be understood as meaning determining the start time and end time of the step. The systems and methods disclosed herein provide a means of tracking the time required to perform a given step in the connection process over the course of a well operation. By enabling a time duration to be attributed to a specific step in the connection process, the disclosed systems and methods make it easier to identify and eliminate sources of ILT relative to conventional systems that estimate only the slip-to-slip connection time.

In basic embodiments, a system in accordance with the present disclosure comprises one or more sensors and one or more processors. The sensors are located at a wellsite. The processors may be located at the same wellsite or at one or more network-connected locations remote from the wellsite.

The sensors are configured to obtain measurements indicative of one or more of the following variables: the block height; the torque applied to the tubular element involved in the connection process; and the rotation rate of the tubular element involved in the connection process.

The processors are configured to detect one or more steps in the connection process using the measurements from the sensors. In well operations that involve connecting additional tubular elements to a tubular string, the steps detected by the processors can include the hoist step (during which the tubular element that is to be connected to the tubular string is hoisted into the derrick of the drilling rig) and the connection make-up step (during which the tubular element in the derrick is connected to the tubular string by means of a threaded connection). In well operations that involve disconnecting tubular elements from a tubular string, the steps can include the connection break-out step (during which the threaded connection joining the uppermost tubular element to the tubular string is disconnected) and the lowering step (during which the disconnected tubular element is laid down).

Systems and methods in accordance with the present disclosure reduce or eliminate the need for rig personnel to measure the duration of steps in the connection process manually, and can be readily implemented at larger scales (e.g., across numerous rigs). Embodiments of the disclosed systems and methods do not necessarily require sensors additional to those typically included as standard equipment in EDR systems. Additionally, embodiments of the disclosed systems and methods can perform well over a range of applications with minimal human intervention and without need for a training dataset.

In one aspect, the present disclosure teaches embodiments of a method for detecting the occurrence of connection make-up or connection break-out in a well operation involving manipulation of tubular elements by a drilling rig, where the method comprises the steps of:

- obtaining time-series measurements indicative of either or both of the rotation rate of one or more tubular elements during rotation by the drilling rig and the torque applied to each of the one or more tubular elements;
- selecting one or more time intervals within the time range spanned by the time-series measurements;
- for each selected time interval, calculating the value of an error function based on the time-series measurements obtained within that time interval; and
- designating a first one of the one or more selected time intervals as corresponding either to connection make-up or to connection break-out if the value of the error function in respect of the first one of the one or more selected time intervals satisfies one or more specified criteria.

The error function may be defined such that a lower error function value indicates a higher degree of correspondence between the first one of the one or more selected time intervals and either connection make-up or connection break-out, and the first one of the one or more selected time intervals may be designated as corresponding either to connection make-up or to connection break-out if the value of the error function in respect of the selected time interval is less than or equal to a specified maximum value. The method may comprise the further step of obtaining time-series measurements indicative of a block height and/or indicative of the rotation rate of the one or more tubular elements; and the one or more time intervals may be selected to span sequential combinations of rotation events. Calculation of the error function value may use one or more inputs selected from the group consisting of:

- a peak torque applied to the one or more tubular elements;
- the elapsed time until the peak torque;
- the number of rotations made by the one or more tubular elements;
- the distance travelled by the travelling block; and
- the total duration of interruptions.

The method may also include the step of isolating the time-series measurements corresponding to a specific tubular element before selecting the one or more time intervals, by the steps of:

multiplying an associated block height by negative one to obtain a negated block height;

specifying a prominence threshold value; and identifying peaks in the negated block height having prominence exceeding the prominence threshold value as corresponding to transitions between tubular elements.

The prominence value may be selected to correspond to the length of the shortest tubular element expected to be involved in the well operation.

In a variant embodiment of this method, the time-series measurements include measurements indicative of a block height, and the method comprises the further steps of:

for each time interval identified as corresponding to connection make-up, designating the block height at the end of the interval as a block height reference datum; and for each time interval identified as corresponding to connection make-up, evaluating whether a change in slips state has occurred at a given point in time following the time interval based on the difference between the block height at the given point in time and the block height reference datum for that time interval.

In another aspect, the present disclosure teaches embodiments of a method for detecting transitions between tubular elements in a well operation involving manipulation of tubular elements by a drilling rig, where the method comprises the steps of:

obtaining time-series measurements indicative of a block height;

multiplying the block height by negative one to obtain a negated block height;

specifying a prominence threshold value; and identifying peaks in the negated block height having prominences exceeding the prominence threshold value as corresponding to transitions between tubular elements.

The prominence threshold value may be selected to correspond to the length of the shortest tubular element expected to be involved in the well operation.

In a further aspect, the present disclosure teaches embodiments of a method for detecting the hoist step or the lowering step in a well operation involving manipulation of tubular elements by a drilling rig, where the method comprises the steps of:

obtaining time-series measurements indicative of a block height;

isolating the time-series measurements corresponding to a specific tubular element;

determining the minimum block height value and the maximum block height value;

specifying a first tolerance value and a second tolerance value;

defining a first reference value as being equal to the minimum block height value if detecting the hoist step, or as being equal to the maximum block height value if detecting the lowering step;

calculating as a function of time the absolute difference between the block height and the first reference value;

detecting the start of the hoist step or the start of the lowering step based on the condition that the absolute difference calculated in step (f) is greater than the first tolerance value;

defining a second reference value as being equal to the maximum block height value if detecting the hoist step, or as being equal to the minimum block height value if detecting the lowering step;

calculating as a function of time the absolute difference between the block height and the second reference value; and detecting the end of the hoist step or the end of the lowering step based on the condition that the absolute difference calculated in step (i) is less than the second tolerance value.

In an additional aspect, the present disclosure teaches embodiments of a method for detecting a change in slips state in a well operation involving manipulation of tubular elements by a drilling rig, where the method comprises the steps of:

obtaining time-series measurements indicative of a block height;

detecting a time interval corresponding to the connection make-up step;

designating the block height at the end of the interval as a block height reference datum; and evaluating whether a change in slips state has occurred at a given point in time, based on the difference between the block height at the given point in time and the block height reference datum.

The present disclosure also teaches embodiments of systems for performing the methods outlined above.

BRIEF DESCRIPTION OF THE DRAWINGS

Embodiments will now be described with reference to the accompanying Figures, in which numerical references denote like parts, and in which.

DETAILED DESCRIPTION

Figure 1:
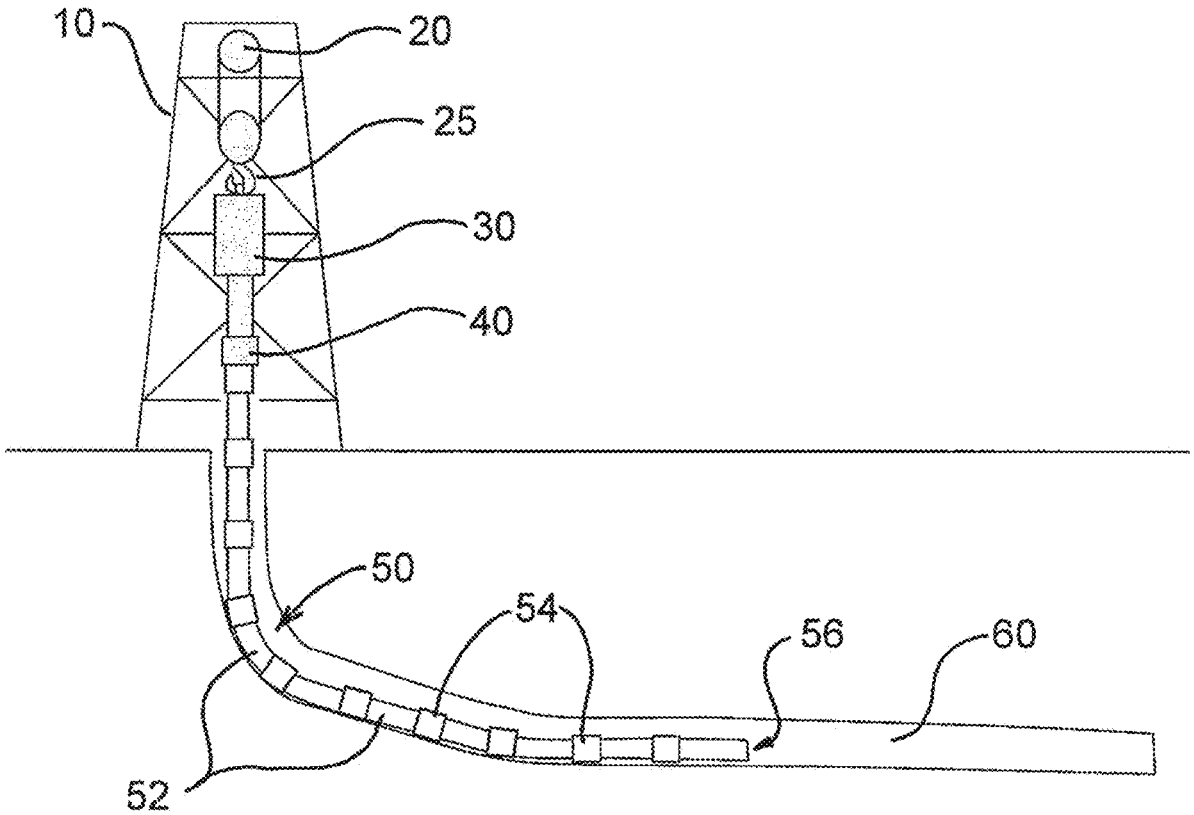
FIG. 1 is a simplified schematic elevation of a well with a tubular string disposed in the wellbore.

FIG. 1 schematically illustrates a typical well operation using a drilling rig. The drilling rig includes a derrick 10 supporting a block-and-tackle 20, which has a hook 25 from which a top drive 30 is suspended. A tool 40 for running tubulars into and out of a well (also referred to as a tubular running tool or a casing running tool, depending on the context) is mechanically connected to top drive 30. Tubular running tool 40 is used to manipulate a tubular string 50 disposed within a wellbore 60 (as well as for "make-up" and "break-out" of tubular string 50 when it is being run into or out of the hole, respectively). Depending on the nature and purpose of the well operation being conducted, top drive 30 may alternatively be connected to tubular string 50 using links and elevators (not shown, but known by persons skilled in the art). Alternatively, top drive 30 may be connected to tubular string 50 using one or more threaded connections.

Tubular string 50 is made up of tubular joints 52 connected end-to-end by threaded couplings 54. A shoe, drill bit, or other downhole tool or device (not shown) will typically be connected to the bottom (or lower end) 56 of tubular string 50, depending on the nature and purpose of the particular well operation being conducted. As well, tubular string 50 may incorporate any of various types of "subs" or other components that are not shown in FIG. 1; accordingly, the components of a tubular string 50 are not limited to the tubular joints 52 and couplings 54.

Figure 2:
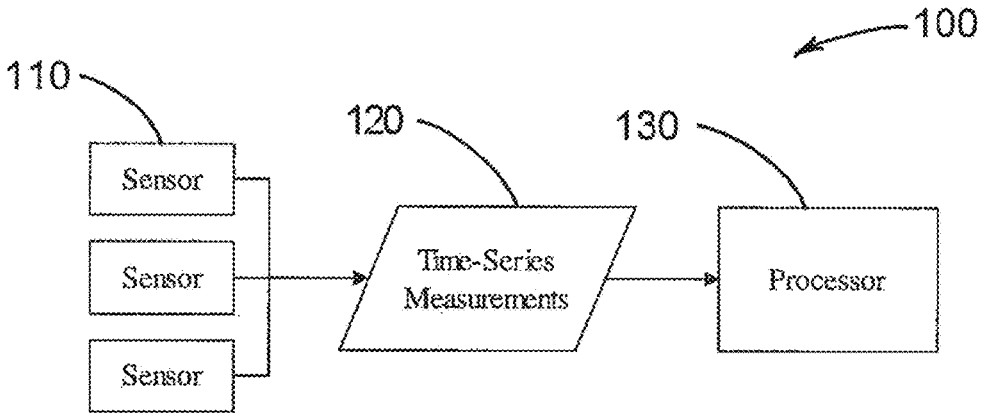
FIG. 2 is a block diagram schematically illustrating a basic embodiment of a system in accordance with the present disclosure.

FIG. 2 schematically illustrates one basic embodiment 100 of a system in accordance with the present disclosure. System 100 includes:

- one or more sensors 110 for obtaining time-series measurements 120; and
- one or more processors 130 configured to receive time-series measurements 120 from the sensors and perform calculations.

The sensors are configured to obtain time-series measurements that can be used to directly or indirectly determine values for one or more of the following variables: the block height; the torque applied to the tubular element involved in the connection process; and the rotation rate of the tubular element involved in the connection process. As used in this specification, the term "time-series measurements" refers to measurements that are obtained periodically over time. The time-series measurements may be obtained at regular intervals (e.g., every second) or at irregular intervals (e.g., more frequently when the variable of interest is changing rapidly, and less frequently when the variable of interest is changing slowly).

In embodiments involving measurement of the block height, the sensors can include a sensor for counting revolutions of the drawworks of the drilling rig. The number of revolutions made by the drawworks can be related to the length of drilling line that has been unspooled and, in turn, to the block height. In embodiments involving measurement of the torque applied to the tubular element involved in the connection process, the sensors can include a top drive torque sensor. In embodiments involving measurement of the rotation rate of the tubular element involved in the connection process, the sensors can include a top drive rotation rate sensor. Alternatively, the sensors can include a sensor for measuring an angular position of the tubular element involved in the connection process, from which the rotation rate can be calculated. The variables of interest (block height, torque, and/or rotation rate) can alternatively be obtained using forms of sensors other than the non-limiting examples provided.

Other types of sensors that can optionally be used to enhance the performance of a system, but which are not required for performance of basic system functionalities, include (but are not limited to):

- a sensor for measuring the hook load;
- a sensor for detecting the slips state (i.e., engaged or disengaged); and
- one or more sensors for measuring drilling fluid pressures and/or fluid flow rates.

Figure 3:
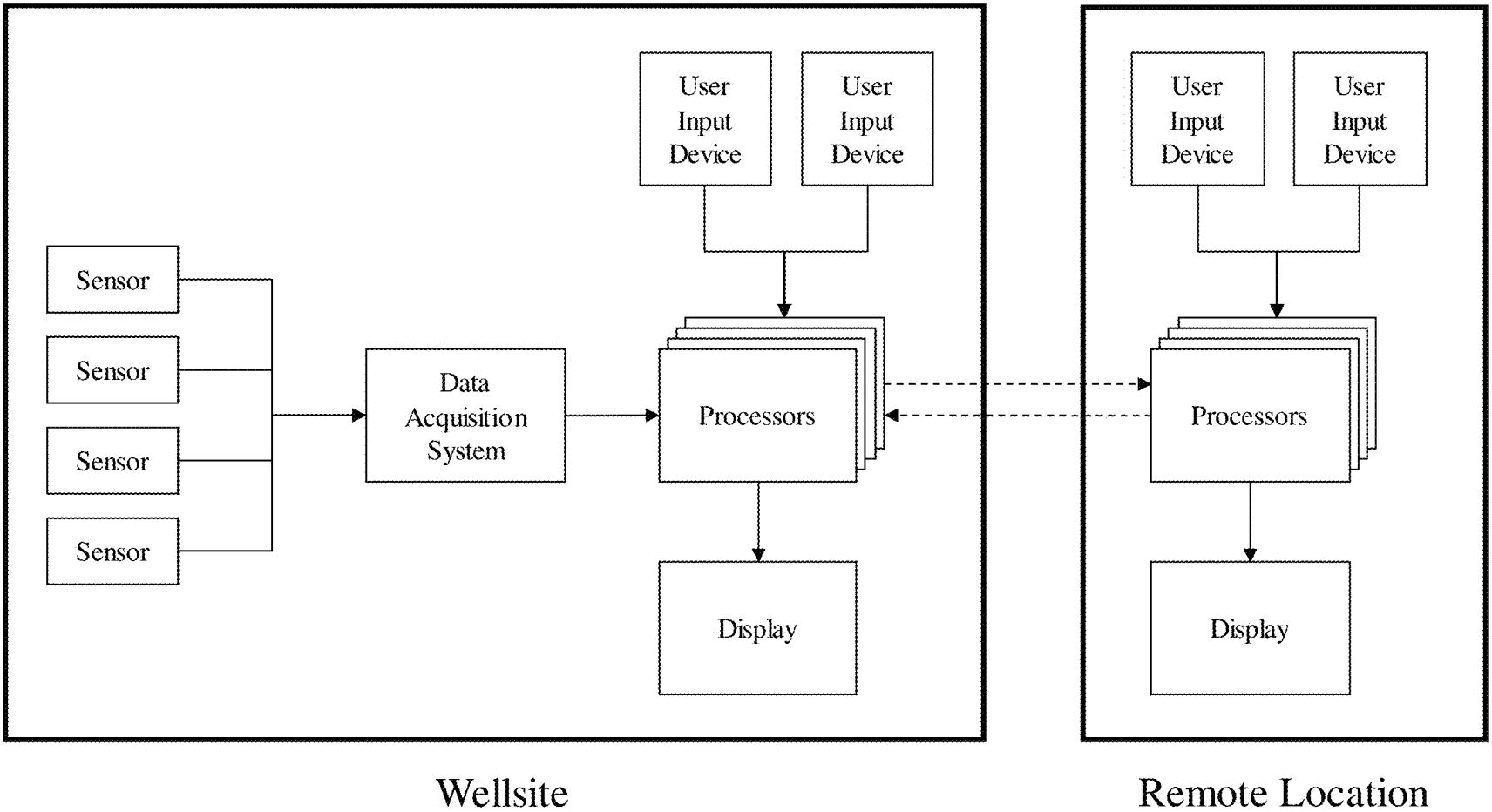
FIG. 3 is a block diagram schematically illustrating a variant of the system in FIG. 2 in which the system includes one or more processors, user input devices, and displays at a location remote from the wellsite.

Embodiments of systems in accordance with the present disclosure can additionally include one or more devices for user input ("user input devices") and one or more displays for configuring the system and showing the results of the calculations to the user of the system ("displays"). Individual processors, user input devices, and displays may be situated in different locations, separate from each other and separate from the sensors. An example of this may be seen in FIG. 3, which schematically illustrates a further embodiment of a system including:

- one or more sensors situated at a wellsite;
- a data acquisition system situated at the wellsite, and in electronic communication with the sensors, for receiving data from the sensors;
- one or more processors situated at the wellsite and in electronic communication with the data acquisition system;
- one or more user input devices situated at the wellsite and in electronic communication with the processors at the wellsite;
- one or more displays situated at the wellsite and in electronic communication with the processors at the wellsite;
- one or more processors situated at a remote location and in electronic communication with the processors at the wellsite;
- one or more user input devices situated at the remote location and in electronic communication with the processors at the remote location; and
- one or more displays situated at the remote location and in electronic communication with the processors at the remote location.

A system in accordance with the present disclosure may be part of a network with intermediate systems between sensors, processors, user input devices, and/or displays. Measurements, results, inputs, and other data may be transmitted between sensors, processors, input devices, and displays using any data transmission or networking protocol and any wired or wireless connection. Examples include but are not limited to serial cables, radio transmissions, ethernet cables, internet protocols, and satellite or cellular networks.

In one embodiment of a system in accordance with the present disclosure, processors, displays, and user input devices form part of a computer system that is located at the wellsite. Additional components of the computer system can include but are not limited to:

- storage media for storing the results of calculations performed by the processor;

audio output devices; and general-purpose data communication connections, such as wired or wireless ethernet to internet allowing remote monitoring.

In one embodiment, a dedicated physical cable, such as a serial cable, can be used to connect the computer system to a data acquisition system, which in turn is connected to the sensors. The connection between the computer system and the data acquisition system can alternatively be made using a dedicated wireless connection or a general-purpose connection, such as wired or wireless ethernet. The computer system can alternatively be connected directly to the sensors.

Steps in the Connection Process

In accordance with the systems and methods of the present disclosure, the connection process when connecting additional tubular elements to a tubular string can be broken down into two main steps:

"Hoist" step: With the weight of the tubular string supported by the slips, the tubular element that is next to be connected to the string is hoisted into the derrick. Depending on the nature and purpose of the well operation being performed, the tubular element may be initially located on pipe racks adjacent to the derrick, or the tubular element may be standing vertically in the derrick in a storage area known as the "pipe setback". In the former case, the hoist step of the connection process may involve attaching the hoisting system to the tubular element, typically using elevators, and lifting the tubular element through the "V-door" on the rig floor. Alternatively, the tubular element may be lifted into the derrick and presented to the hoisting system by means of a separate pipe handling system. If the tubular element is initially located in the pipe setback, the hoist step may involve raising the travelling block so that the hoisting system can be attached to the upper end of the tubular element. In all cases, the hoist step of the connection process is characterized by upward motion of the travelling block before connection make-up.

"Connection make-up" step: In this step, the lower end of the tubular element, which typically carries the male portion of a threaded connection, is inserted into the upper end of the tubular string, which typically carries the female portion of the threaded connection. The tubular element is rotated relative to the string to make up the threaded connection by means of power tongs, an iron roughneck, the top drive, or other equipment. Connection make-up typically terminates when the male portion of the connection reaches a prescribed position relative to the female portion of the connection or a prescribed rotation angle after initial contact, and/or when the applied torque reaches a prescribed value.

In addition to the two main steps described above, there are additional steps when connecting tubular elements to a tubular string that contribute to the total time required for the connection process. In accordance with systems and methods disclosed herein, these additional steps can be broken down as follows:

"Prepare-to-hoist" step: This step relates to activities carried out during the time interval between engagement of the slips and the beginning of the hoist step. Activities carried out during this step can include filling the tubular string with drilling fluid, and positioning and latching the elevators on the tubular element that is to be hoisted into the derrick.

"Prepare-to-make-up" step: This step relates to activities carried out during the time interval between the end of the hoist step and the start of the connection make-up step. Activities carried out during this step can include removing thread protectors, applying thread compound, and positioning and attaching power tongs, an iron roughneck, a casing running tool, or other make-up equipment.

"Prepare-to-run" step: This step relates to activities carried out during the time interval between the end of the connection make-up step and disengagement of the slips. Activities carried out during this step can include removing the power tongs, the iron roughneck, or other make-up equipment, and reviewing torque-turns data to ensure that the connection make-up satisfied specified requirements.

In accordance with systems and methods disclosed herein, the connection process when disconnecting tubular elements from a tubular string can similarly be broken down into two main steps:

"Connection break-out" step: With the weight of the tubular string supported by the slips, the uppermost tubular element is rotated relative to the string to disengage the threaded connection by means of power tongs, an iron roughneck, the top drive, or other equipment. Connection break-out terminates when the tubular element is completely disengaged from the string.

"Lowering" step: In this step, the tubular element that was disconnected from the tubular string is lowered from the derrick. Depending on the nature and purpose of the well operation being performed, the tubular element may be returned to pipe racks adjacent to the derrick, or it may be stood up vertically in the pipe setback. In the former case, the lowering step of the connection process may involve lowering the tubular element through the V-door on the rig floor (typically using elevators), and detaching the hoisting system from the tubular element. Alternatively, the tubular element may be lowered from the derrick by means of a separate pipe handling system. If the tubular element is to be returned to the pipe setback, the lowering step may involve lowering the travelling block so that the hoisting system can be attached to the remaining tubular string. In all cases, the lowering step of the connection process is characterized by downward motion of the travelling block after connection break-out.

The connection process when disconnecting tubular elements from a tubular string can be further broken down into the following additional steps:

"Prepare-to-break-out" step: This step relates to activities carried out during the time interval between engagement of the slips and the beginning of the connection break-out step. Activities carried out during this step can include positioning and attaching power tongs, an iron roughneck, or other break-out equipment.

"Prepare-to-lower" step: This step relates to activities carried out during the time interval between the end of the connection break-out step and the beginning of the lowering step. Activities carried out during this step can include removing the power tongs, the iron roughneck, or other break-out equipment.

"Prepare-to-pull" step: This step relates to activities carried out during the time interval between the end of the lowering step and disengagement of the slips. Activities carried out during this step can include attaching the hoisting system to the tubular string.

Hoist Detection

As described previously, the hoist step of the connection process is characterized by upward motion of the travelling block prior to connection make-up. It is challenging to automate detection of the hoist step for several reasons:

There may be upward motion of the travelling block during the prepare-to-hoist step. Automated methods must be able to distinguish this motion from the hoist step itself.

There may be temporary pauses in the upward motion of the travelling block during the hoist step. Automated methods must be able to distinguish between these temporary pauses and the end of the hoist step.

Block height measurements are prone to "drift", such that error in the block height measurement accumulates over time and leads to a significant offset between the measured block height and the true block height. Automated methods must be able to detect the hoist step reliably even when there is significant drift in the block height measurement.

Figure 4:
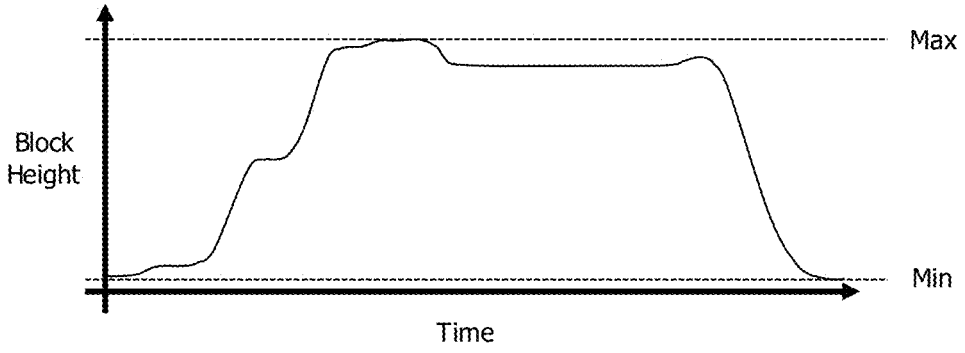
FIG. 4 shows a sample of time-series block height data for which minimum and maximum block height values have been identified.
Figure 5:
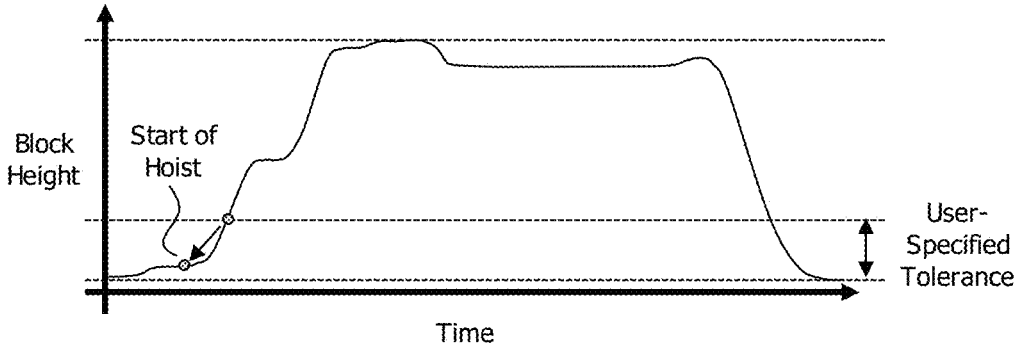
FIG. 5 illustrates a method for detecting the start of the hoist step of the connection process, based on time-series block height data such as in FIG. 4.
Figure 6:
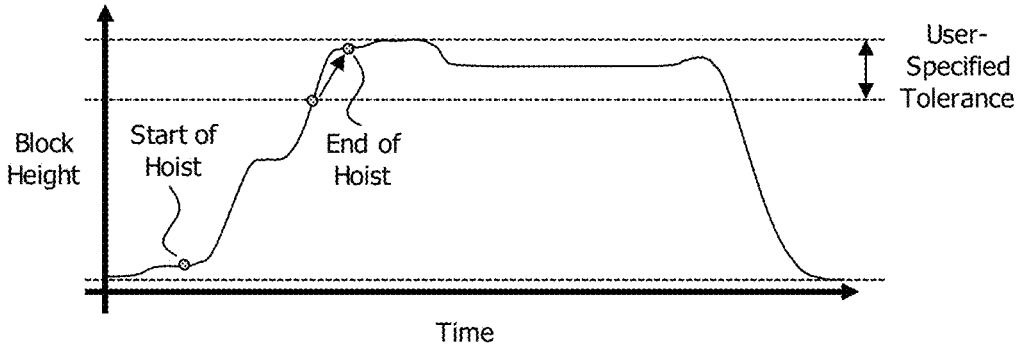
FIG. 6 illustrates a method for detecting the end of the hoist step of the connection process, based on time-series block height data such as in FIG. 4.

To overcome these challenges, in embodiments of systems in accordance with the present disclosure, the processors may be configured to detect the hoist step of the connection process using the following method steps:

1. Isolate a sample of time-series block height data believed to contain the hoist step. If the slips state can be estimated reliably (e.g., using conventional hook-load-based methods), the start of the sample can be selected to coincide with the engagement of the slips, and the end of the sample can be selected to coincide with the disengagement of the slips. An alternative approach for isolating the data sample, which can be effective in situations where conventional methods for estimating the slips state fail, is described later in this disclosure. Other approaches for isolating the data sample may be used for purposes of methods disclosed herein without departing from the scope of the present disclosure.
2. Calculate and record the minimum and maximum block height values in the data sample (see FIG. 4).
3. Beginning at the start of the data sample, step forward through the data sample. If the block height exceeds the minimum block height value by a specified tolerance, begin searching for the start of the hoist step (see FIG. 5):

Beginning at the point in time at which the block height exceeded the minimum block height value by the specified tolerance, step backwards through the data sample. The start of the hoist step corresponds to the last point in time at which the travelling block was stationary or changed direction.
4. Beginning at the point in time at which the block height exceeded the minimum block height value by the specified tolerance, resume stepping forward through the data sample. If the block height approaches the maximum block height value within a second specified tolerance, begin searching for the end of the hoist step (see FIG. 6):

Continue stepping forward through the data sample. The end of the hoist step corresponds to the next point in time at which the travelling block stopped moving upward.

In this disclosure, to "step through" a data sample means to give consideration to individual data points contained in the data sample in a consecutive or sequential manner, advancing from one data point to the next. To "step forward" through a data sample means to step through the data sample in the positive time direction; to "step backwards" through a data sample means to step through the data sample in the negative time direction.

Testing has indicated that a value of approximately 3 metres (10 feet) is suitable for the specified tolerances with respect to hoist step detection, but the optimal value of the specified tolerances can vary depending on rig equipment and operating procedures. The values of the specified tolerances from the minimum and maximum block heights may differ.

In cases where there is significant noise in the block height measurement, the performance of the present method may be improved by pre-processing the time-series block height data to reduce or eliminate the noise. Alternative embodiments of methods in accordance with the present disclosure include an initial step wherein the time-series block height data is pre-processed using a noise-reduction filter.

Lowering Detection

As described previously, when disconnecting tubular elements from a tubular string, the connection process includes a lowering step that is characterized by downward (rather than upward) motion of the travelling block. In embodiments of systems in accordance with the present disclosure, the processors may be configured to perform a generalized method that is suitable for detecting either the hoist step or lowering step, depending on whether tubular elements are being connected to or disconnected from a tubular string. This generalized method includes the following steps:

1. Isolate a sample of time-series block height data believed to contain the hoist step or the lowering step (as the case may be). The start and end of the sample can be selected to coincide with the engagement and disengagement (respectively) of the slips, or alternative approaches for isolating the data sample can be employed.
2. Determine the minimum and maximum block height values in the data sample.
3. Define a first reference value as being equal to the minimum block height value if detecting the hoist step, or as being equal to the maximum block height value if detecting the lowering step.
4. Calculate as a function of time the absolute difference between the block height and the first reference value.
5. Detect the start of the hoist step or the lowering step (as the case may be), based on the condition that the absolute difference calculated in step 4 is greater than a first user-specified tolerance:

Beginning at the first point in time at which the absolute difference calculated in step 4 exceeds the first user-specified tolerance, step backwards through the data sample. The start of the hoist step or the lowering step (as the case may be) corresponds to the last point in time at which the travelling block was stationary or changed direction.
6. Define a second reference value as being equal to the maximum block height value if detecting the hoist step or as being equal to the minimum block height value if detecting the lowering step.
7. Calculate as a function of time the absolute difference between the block height and the second reference value.
8. Detect the end of the hoist step or the lowering step (as the case may be), based on the condition that the absolute difference calculated in step 7 is less than a second user-specified tolerance:

Beginning at the first point in time at which the absolute difference calculated in step 7 is less than the second user-specified tolerance, step forward through the data sample. The end of the hoist step or the lowering step (as the case may be) corresponds to the next point in time at which the travelling block was stationary or changed direction.

Connection Make-Up Detection

To make up the connection between a tubular element suspended in the derrick and a tubular string suspended in the slips, the tubular element is rotated relative to the string. This rotation can be achieved by means of power tongs, an iron roughneck, a top drive, or other equipment.

In embodiments of systems in accordance with the present disclosure, the processors may be configured to detect the connection make-up step of the connection process using time-series measurements indicative of the rotation rate of the tubular element involved in the connection process and/or the torque applied to the tubular element. The functionality of the method does not depend on the specific equipment used for connection make-up, provided that rotation rate data and/or torque data are available. This method includes the following steps:

1. Select one or more time intervals within the time range spanned by the time-series rotation rate measurements and/or time-series torque measurements.
2. Define an error function (which may be alternatively referred to as a cost function) for evaluating the degree of correspondence between the measurements in a selected time interval and the connection make-up step. As used in this specification, the term "error function" refers to a mathematical function that receives as input one or more values, at least one of which is derived from the measurements in a selected time interval, and provides as output a value whose magnitude indicates the degree of correspondence between the measurements in the selected time interval and a selected step in the connection process. The specific form of the error function can vary; however, for the purpose of detecting the connection make-up step, the error function may be defined such that a lower error function value indicates a higher likelihood that a given time interval corresponds to the connection make-up step.
3. Calculate the value of the error function for each time interval selected in Step 1.
4. Based on the error function values calculated in Step 3, designate one or more time intervals as corresponding to the connection make-up step. If the error function was defined such that a lower error function value indicates a higher degree of correspondence between a selected time interval and the connection make-up step, then time intervals having error function values less than or equal to a selected maximum acceptable value may be designated as corresponding to the connection make-up step. If there is overlap between two time intervals having error function values less than or equal to the maximum acceptable value, the time interval with the lower error function value may be designated as corresponding to the connection make-up step.

One possible definition for the error function is as follows:

$$E = \frac{\sum_i w_i \left| \frac{m_i - e_i}{b_i} \right|}{\sum_i w_i}$$

where E is the error function value;

$m_i$ is the measured value of parameter i;

$e_i$ is the expected value of parameter i;

$b_i$ is a value of parameter i used as the basis for normalization; and $w_i$ is the weighting of parameter i in the error function.

The preceding exemplary error function formula involves comparing the measured value $m_i$ of one or more parameters to an expected value $e_i$. The larger the difference between the measured and expected values, the larger the associated contribution to the error function value. To enable the error function to include parameters with dissimilar magnitudes and units, the difference between the measured and expected values is normalized with respect to a basis value $b_i$. In this context, to "normalize" a value means to express the value as a ratio relative to a basis value with like units. The magnitude of the basis value is selected such that the ratio falls within a desired range (typically, but not necessarily, from zero to one). In the computation of the error function value E, the contribution of each parameter i is weighted according to the corresponding weighting $w_i$. The higher the weighting for a given parameter, the greater the influence of that parameter on the error function value.

In some embodiments of the method, the error function may have the form set out in the formula above, and the measured parameters of the error function may include one or more of the parameters listed in Table 1 below.

In Table 1, the "peak torque" is defined as the maximum torque applied to the tubular element involved in the connection process during a selected time interval. The "elapsed time until peak torque" is defined as the elapsed time between the start of the selected time interval and the occurrence of the peak torque. "Interruptions" are defined as intervals in time over which the rotation rate of the tubular element or the torque applied to the tubular element was less than or equal to a specified threshold value.

TABLE 1

| Measured Parameter | Expected Value, $e_i$ | Basis for Normalization, $b_i$ |
|---|---|---|
| Peak torque | User-specified, depending on type of threaded connection | Equal to expected value |
| Elapsed time until peak torque | Total duration of selected time interval | Total duration of selected time interval |
| Number of rotations made by the tubular element in the derrick | User-specified, depending on type of threaded connection | Equal to expected value |
| Distance travelled by the travelling block | Zero | Typical length of tubular elements involved in well operation |
| Total duration of interruptions | Zero | Total duration of selected time interval |

In alternative method embodiments, the error function may be defined as follows:

$$E = 1 - \frac{\sum_i w_i \left| \frac{m_i - e_i}{b_i} \right|}{\sum_i w_i}$$

where the variables are as defined previously. In these embodiments, an error function value closer to one (1) indicates a higher degree of correspondence between a selected time interval and the connection make-up step, and time intervals having error function values sufficiently close to one (1) are designated as corresponding to the connection make-up step.

In embodiments of the method involving an error function with two or more measured parameters, the optimal value for the weighting of each parameter will depend on the specific parameters selected and the nature of the well operation being analyzed. In one embodiment, the basis values used for normalization are selected such that, under normal conditions, the method provides good performance with equal weighting of the measured parameters. If exceptional conditions are encountered under which the performance of the method is inadequate, the method can be "tuned" to improve performance by adjusting one or more of the weightings.

Various methods can be used to select the time intervals for which the error function is to be evaluated. One method involves considering numerous overlapping time intervals of equal length, with each time interval being offset from the previous time interval by a specified time offset. With large datasets, however, this method is computationally intensive. Therefore, in embodiments of systems in accordance with the present disclosure, one or more sensors may be used to obtain measurements indicative of the rotation rate of the tubular element involved in the connection process, and the processors may be configured to select the time intervals using the following method:

1. Beginning at the start of the time-series rotation rate measurements, step through the measurements and identify the start and end of all rotation events, where a "rotation event" is defined as an interval in time over which the rotation rate exceeded a specified threshold value. Testing has shown that a value of 0.1 rotations per minute is suitable for the threshold value, but the threshold value can alternatively be set to zero or any other value.
2. Identify all possible sequential combinations of rotation events. A "sequential combination of rotation events" means a group of one or more rotation events that occurred sequentially in time (i.e., without interruption by a rotation event not included in the group). For example, if three rotation events (Events 1, 2, and 3) are identified in Step 1, there are six possible sequential combinations of rotation events: Event 1; Event 2; Event 3; Events 1 and 2; Events 2 and 3; and Events 1, 2, and 3. (Note that the combination of Events 1 and 3 is not a sequential combination of rotation events.) More generally, if n rotation events are identified in Step 1, there are n(n+1)/2 possible sequential combinations of rotation events.
3. Proceed with detecting the connection make-up step as described previously, using the sequential combinations of rotation events identified in Step 2 as the time intervals for which the error function is evaluated.

Figure 7:
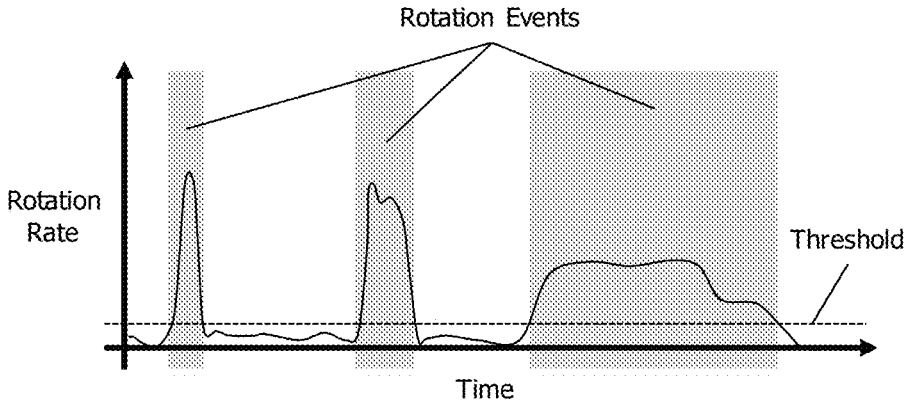
FIG. 7 shows a sample of time-series rotation rate data for which all rotation events have been identified (where a "rotation event" is defined as a time interval over which the rotation rate exceeded a specified threshold value).
Figure 8:
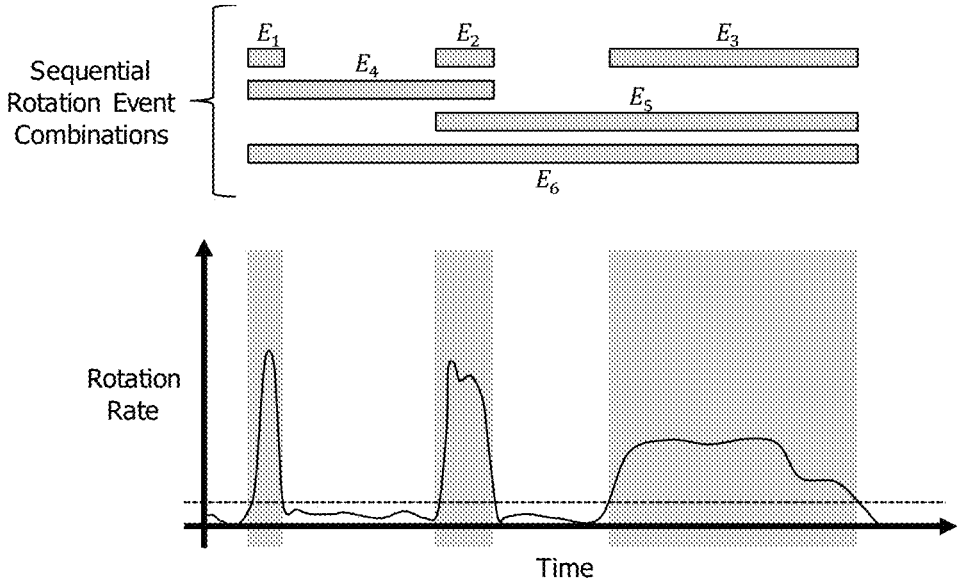
FIG. 8 shows all sequential combinations of rotation events in a sample of time-series rotation rate data, where each sequential combination j of rotation events has an associated error function value $E_j$.
Figure 9:
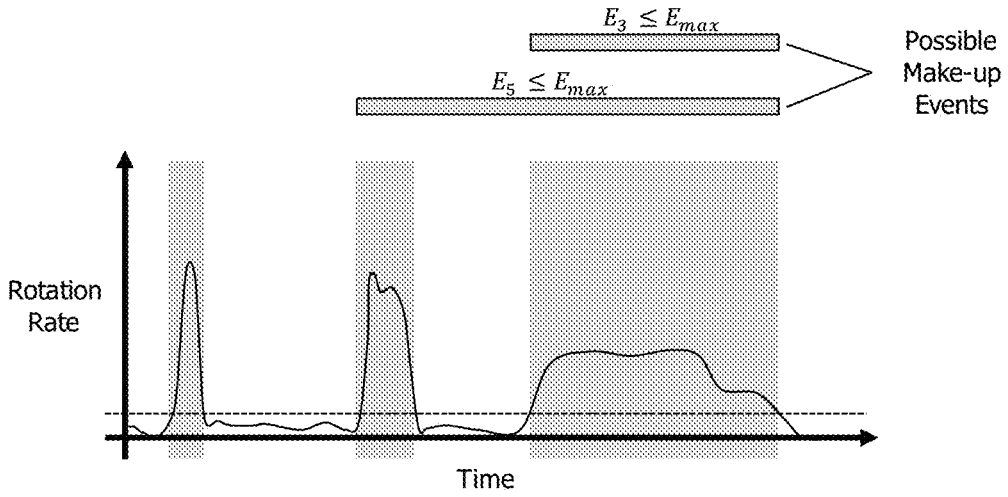
FIG. 9 shows sequential combinations of rotation events in a sample of time-series rotation rate data with error function values less than or equal to a maximum acceptable value $E_{max}$.
Figure 10:
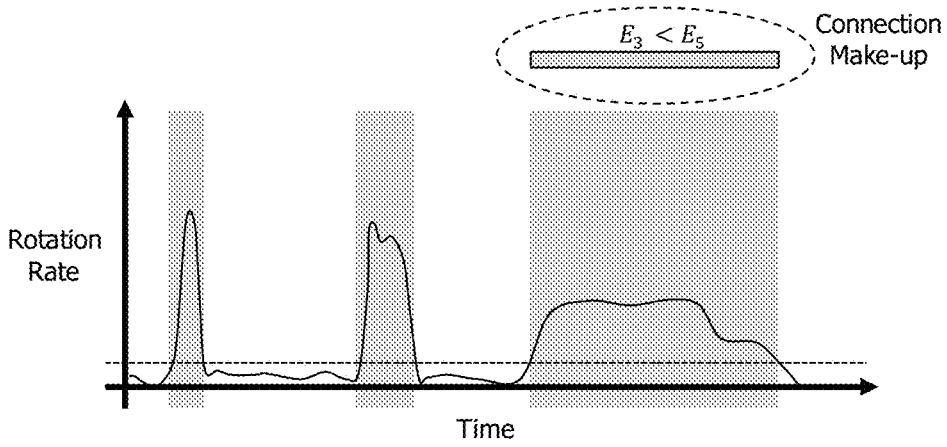
FIG. 10 shows a sample of time-series rotation rate data for which the connection make-up step has been identified.

FIG. 7 to FIG. 10 illustrate the preceding method embodiment. In FIG. 7, the rotation events in a sample of rotation rate data are identified. The rotation events correspond to time intervals over which the rotation rate exceeded a specified threshold value. In FIG. 8, all possible sequential combinations of rotation events are identified, and an error function value $E_j$ is calculated for each sequential combination j of rotation events. In FIG. 9, two sequential combinations of rotation events (with corresponding error function values $E_3$ and $E_5$) are found to have error function values less than or equal to a selected maximum acceptable value $E_{max}$. In FIG. 10, the sequential combination of rotation events with the lower error function value ($E_3$) is designated as corresponding to the connection make-up step.

In cases involving large quantities of data, the computational efficiency of the present methods can be improved by isolating a sample of time-series rotation rate data and/or time-series torque data corresponding to an individual tubular element prior to detecting the connection make-up step for that element. If the hoist step has been detected, the start of the sample can be selected to coincide with the end of the hoist step; otherwise, the start of the sample can be selected to coincide with the engagement of the slips. The end of the sample can be selected to coincide with the disengagement of the slips. Alternative methods for isolating the data sample may be used for purposes of methods disclosed herein without departing from the scope of the present disclosure.

The methods described herein do not require the connection process to include only a single connection make-up step; multiple connection make-up steps may be detected. This is the expected outcome when a connection make-up is rejected by rig personnel, requiring the connection to be broken out and made up again.

When it is not feasible or desirable to isolate a data sample corresponding to an individual tubular element, or when analyzing data from a well operation in real time, methods disclosed herein can be used to search for connection make-up steps in time-series measurements.

In one method embodiment employing a "moving window" approach, rotation events in the data are first identified. Beginning at a first rotation event, a data sample is defined that has a specified duration (e.g., five minutes) and terminates at the end of the first rotation event. All sequential combinations of rotation events within the data sample are evaluated using an error function as described previously to identify rotation event combinations likely to correspond to the connection make-up step. Then, stepping forward to a second rotation event, the data sample is redefined to terminate at the end of the second rotation event while maintaining the same specified duration. All sequential combinations of rotation events within the data sample are once again evaluated using an error function. The method repeats, stepping forward through the data from one rotation event to the next, and redefining the data sample at each step.

In disclosed method embodiments, rotation rate data may be used in combination with a specified threshold value to define rotation events. In alternative embodiments, torque data may be used in combination with an alternative threshold value to define "torque events", and sequential combinations of torque events may be evaluated using an error function to identify torque event combinations likely to correspond to the connection make-up step.

Embodiments of methods in accordance with the present disclosure may include an initial step wherein the time-series rotation rate and/or torque data are pre-processed using a noise-reduction filter to improve performance in cases where there is noise in the rotation rate measurement and/or torque measurement.

Method embodiments may use a "deadband" approach to identify rotation events or torque events. With this approach, the start of a rotation event (torque event) is defined based on the rotation rate (or the applied torque if identifying torque events) exceeding a first threshold value, and the end of a rotation event (or torque event, as the case may be) is defined based on the rotation rate (or torque) decreasing to a second, lower threshold value, with the difference between the two threshold values being termed the "deadband".

Connection Break-Out Detection

In embodiments of systems in accordance with the present disclosure, the processors may be configured to detect the connection break-out step using a method similar to that described previously for detecting the connection make-up step, but with a modified error function.

One embodiment uses an error function selected from the forms shown previously with parameters similar to those listed in Table 1; for connection break-out step detection, however, the expected value for the "elapsed time until peak torque" is zero. The rationale for this modification is that the peak torque is typically expected to occur at or near the start of connection break-out (rather than at or near the end of connection make-up).

In embodiments involving the use of sensors that provide measurements indicative of the direction of rotation of the tubular element involved in the connection process (not just the rate of rotation), connection make-up and connection break-out can be differentiated by the rotation direction. One such embodiment uses an error function selected from the forms shown shown previously with parameters similar to those listed in Table 1. However, the "number of rotations made by the tubular element in the derrick" can be a positive or negative value, with positive values representing clockwise rotation of the tubular element (when viewed from above), and with negative values representing counter-clockwise rotation. As the majority of tubular connections use right-handed threads, the expected value is typically positive if detecting connection make-up, and typically negative if detecting connection break-out.

Systems and methods for detecting connection break-out find utility not only when a tubular string is being pulled out of a well, but also when a tubular string is being run into a well. When a tubular string is being run into a well, it is common for a connection make-up to be rejected by rig personnel (e.g., for exhibiting unusual torque-turn characteristics), requiring the connection to be broken out. Embodiments of systems and methods in accordance with the present disclosure can enable the number of connection break-outs during a tubular running operation to be readily determined or inferred with a high degree of reliability. An unusually high number of connection break-outs can indicate equipment or training issues.

Determining Type of Well Operation

In some embodiments of systems in accordance with the present disclosure, the user of the system can specify whether the tubular string is being run into the well or pulled out of the well, and the system can detect steps in the connection process accordingly (e.g., the system can detect the hoist step if the tubular string is being run into the well, or can detect the lowering step if the tubular string is being pulled out of the well).

In alternative embodiments, the type of well operation being performed can be determined automatically. One such embodiment uses the methods described previously for detecting connection make-up or connection break-out to determine whether the tubular string is being run into the well or pulled out of the well. The detection of consecutive connection make-ups, without intervening connection break-outs, indicates that the tubular string is being run into the well. The detection of consecutive connection break-outs, without intervening connection make-ups, indicates that the tubular string is being pulled out of the well.

If the slips state can be estimated reliably (e.g., using conventional hook-load-based methods), then the type of well operation being performed can be determined or inferred using block height measurements. If the motion of the travelling block is predominantly downwards while the slips are disengaged, then the tubular string is being run into the well. If the motion of the travelling block is predominantly upwards while the slips are disengaged, then the tubular string is being pulled out of the well. Many EDR systems use slips state estimates in combination with block height measurements to estimate the depth of the tubular string in the well. If such a depth estimate is available, then the direction of the change in the depth estimate (i.e., increasing or decreasing) can be used to determine the type of well operation being performed.

Duration of Steps in Connection Process

When connecting additional tubular elements to a tubular string, the duration of each step in the connection make-up process can be calculated once the hoist and connection make-up steps have been detected, as follows:

- Duration of the "prepare-to-hoist" step—equals the elapsed time between engagement of the slips and the start of the hoist step;
- Duration of the "hoist" step—equals the elapsed time between the start and end of the hoist step;
- Duration of the "prepare-to-make-up" step—equals the elapsed time between the end of the hoist step and the start of the connection make-up step;
- Duration of the "connection make-up" step—equals the elapsed time between the start and end of the connection make-up step; and
- Duration of the "prepare-to-run" step—equals the elapsed time between the end of the connection make-up step and disengagement of the slips.

When disconnecting tubular elements from a tubular string, the duration of each step in the connection break-out process can be calculated as follows:

- Duration of the "prepare-to-break-out" step—equals the elapsed time between engagement of the slips and the start of the connection break-out step;
- Duration of the "connection break-out" step—equals the elapsed time between the start and end of the connection break-out step;
- Duration of the "prepare-to-lower" step—equals the elapsed time between the end of the connection break-out step and the start of the lowering step;
- Duration of the "lowering" step—equals the elapsed time between the start and end of the lowering step; and
- Duration of the "prepare-to-pull" step—equals the elapsed time between the end of the lowering step and disengagement of the slips.

In embodiments of systems in accordance with the present disclosure, when one or more time intervals cannot be associated with a known step in the connection process, the time intervals may be labelled as "unknown" (or similar) to alert the user of the system to potential anomalies.

Tubular Element Detection

As discussed previously, drilling rigs do not typically have a sensor for detecting the slips state. The slips state is commonly estimated by comparing the measured hook load to a specified value, but this method is prone to error, particularly during operations at shallow depths, operations involving light tubulars, and operations in deviated or horizontal wells. Error in the estimated slips state can make it challenging to isolate samples of time-series data corresponding to the connection process, and can lead to error when estimating the duration of the different connection steps.

Figure 11:
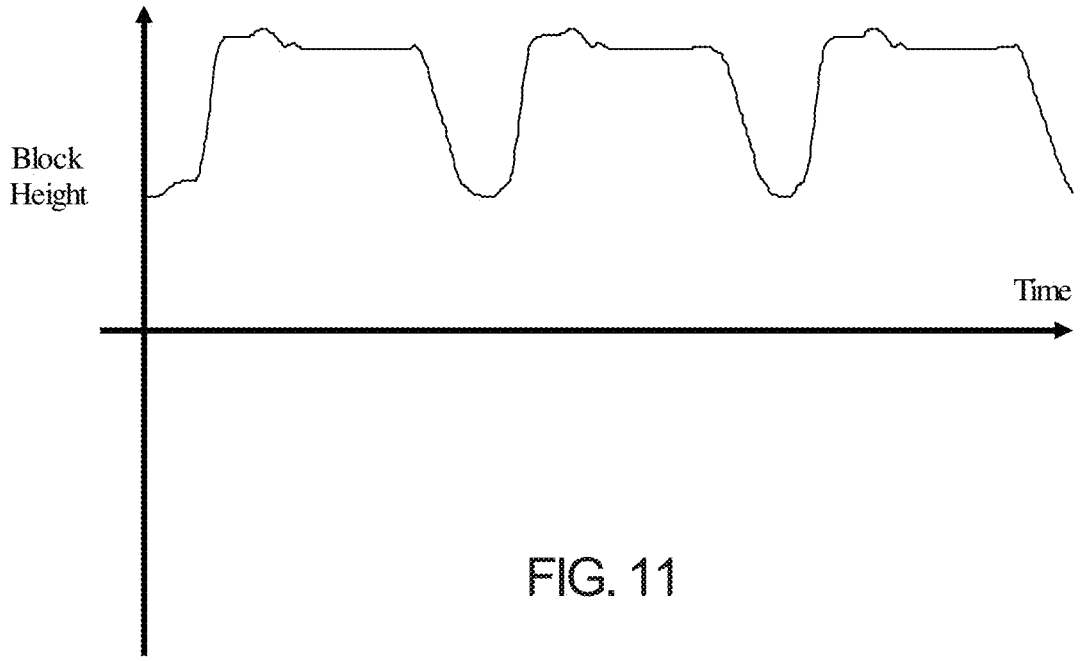
FIG. 11 shows sample time-series block height data from a casing running operation.
Figure 12:
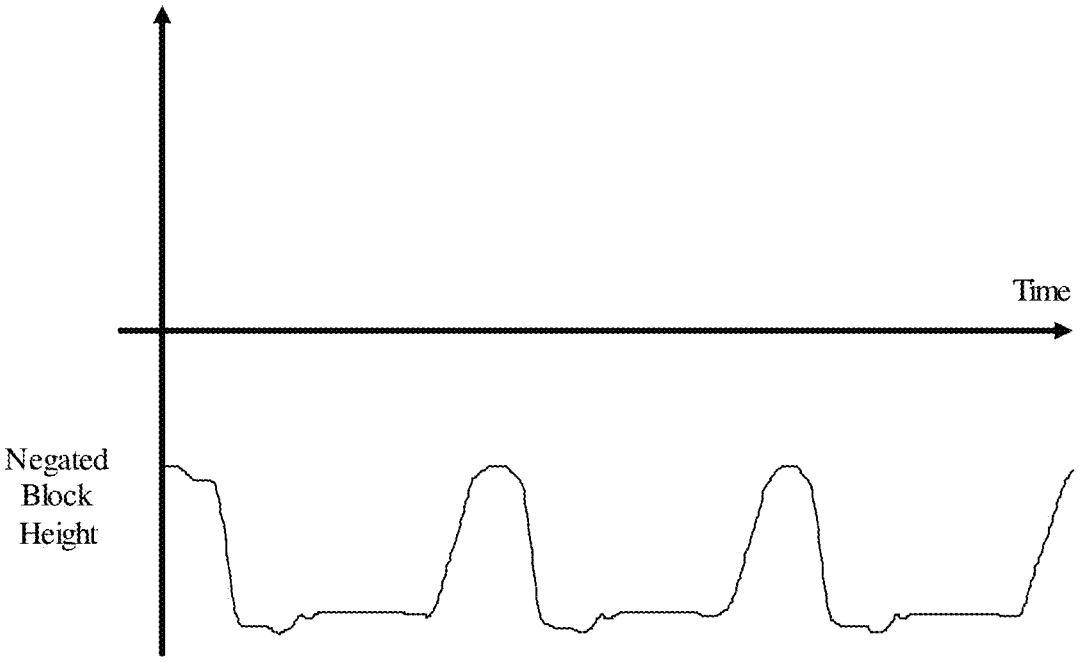
FIG. 12 shows the time-series block height data of FIG. 11 after negation.
Figure 13:
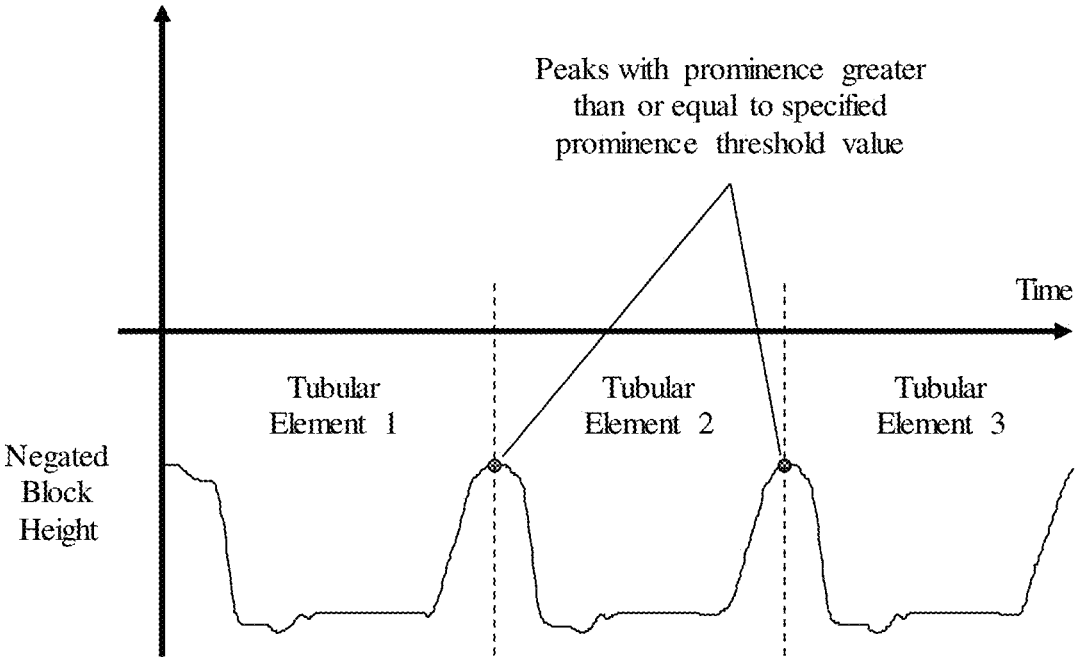
FIG. 13 shows the peaks in the negated block height data of FIG. 12 with prominence greater than or equal to a specified prominence threshold value.

To overcome these challenges, in embodiments of systems in accordance with the present disclosure, the processors may be configured to perform an alternative method to isolate a sample of time-series data corresponding to the connection process for a given tubular element. These method embodiments take advantage of the periodic motion of the travelling block typical of well operations involving tubular strings, and use a peak-finding algorithm in combination with time-series block height data. Given the time-series block height data corresponding to a well operation, the method steps involved include the following:

1. Negate the time-series block height data. In this context, to "negate" the time-series block height data means to multiply every block height value by negative one (−1), such that the peaks (maxima) in the original data become valleys (minima) in the negated data, and the valleys in the original data become peaks in the negated data. FIG. 11 shows sample time-series block height data from a casing running operation, and FIG. 12 shows the same data after negation.
2. Define a prominence threshold value, which will be used to interpret the peaks in the negated block height data. The prominence threshold value should be close to but less than the length of the tubular elements involved in the well operation.
3. Using a peak-finding algorithm, locate all peaks in the negated block height data with prominence greater than or equal to the specified prominence threshold value. These peaks represent transitions between tubular elements (see FIG. 13).

Various peak-finding algorithms are available. One basic approach for finding peaks in time-series data involves stepping through the data and comparing each value to its neighbouring values (i.e., the values immediately before and immediately after the given value). If a given value is greater than its neighbouring values, then the given value corresponds to a peak. In this approach, plateaus in the data (i.e., two or more consecutive values that are equal) can be treated as a single data point, such that a plateau is identified as a peak if it is preceded and followed by smaller values.

The "prominence" of a peak, as used in this disclosure, is a measure of the peak's height relative to a selected benchmark value associated with its surroundings. Given negated block height data expressed as a curve on a plot of negated block height against time, one exemplary method for defining the prominence of a peak is as follows:

1. Define a horizontal line that begins at the peak and extends rightward (i.e., in the positive time direction) until either:
   - The horizontal line intersects the negated block height curve; or
   - the end of the negated block height time-series data is reached.
2. Calculate the minimum negated block height value in the time interval spanned by the horizontal line defined in Step 1.
3. Define a horizontal line that begins at the peak and extends leftward (i.e., in the negative time direction) until either:
   - the horizontal line intersects the negated block height curve; or
   - the start of the negated block height time-series data is reached.
4. Calculate the minimum negated block height value in the time interval spanned by the horizontal line defined in Step 3.
5. Calculate the prominence of the peak as the height of the peak above the higher of the two negated block height minima calculated in Steps 2 and 4.

In cases where the data from a well operation is being analyzed in real time, methods for defining the prominence of a peak that consider only past data may be employed.

In essence, this method embodiment involves searching for prominent minima in the time-series block height data from a well operation, and interpreting those minima as transitions between tubular elements. It is effective when the most prominent minima in the block height time-series data coincide approximately with the engagement of the slips, which is commonly the case for tubular running operations.

In the preceding description, the block height data is negated to enable the use of established peak-finding algorithms. In an alternative embodiment, however, the method involves searching for minima in the original (i.e., non-negated) block height data.

In a further alternative embodiment, a peak-finding algorithm is used in combination with the original (non-negated) block height data to locate maxima in the original block height data. However, testing has shown that the resulting maxima may not coincide consistently with a particular step in the connection process.

The performance of the method embodiments described above depends on the selected prominence threshold value. A smaller prominence threshold value means that the method will be more likely to detect transitions between tubular elements, but it also means that the method will be more prone to "false positives" (indications that a transition between tubular elements occurred when, in reality, no transition occurred). A larger prominence threshold value means that the method will be less prone to false positives, but it also increases the likelihood that the method will fail to identify a transition between tubular elements. Typically, the prominence threshold value should be no greater than the length of the shortest tubular element to be run into the well. If the length range of the tubulars involved in a well operation is known, the prominence threshold value can be selected to correspond to the lower end of the length range.

To reduce the frequency of false positives, system embodiments may use the preceding method for detecting transitions between tubular elements in combination with the methods described previously for detecting connection make-up or connection break-out. The connection process for any tubular element is expected to involve at least one connection make-up step or one connection break-out step. Failure to detect any connection make-up or connection break-out steps can therefore indicate a false positive.

In the context of this disclosure, the preceding method for detecting transitions between tubular elements is useful for dividing the time-series data from a well operation into samples that can be associated with the connection process for individual tubular elements, and can be used with methods described earlier in this disclosure for detecting the hoist, lowering, connection make-up, and connection break-out steps. More generally, however, the method has utility wherever there is a desire to track individual tubular elements. For example, the method could form the basis of an automated pipe tally system.

Slips State Estimation

Frequently, the most prominent minima in the time-series block height data from a well operation will coincide approximately with the engagement of the slips. Accordingly, the particular method embodiment described in the preceding section for detecting transitions between tubular elements can be considered as a method for detecting engagement of the slips. This method is useful for estimating the slips state in scenarios where conventional hook-load-based methods fail (e.g., operations at shallow depths, operations involving light tubulars, and operations in deviated or horizontal wells).

To obtain a complete slips state estimate, disengagement of the slips must also be detected. In embodiments of systems in accordance with the present disclosure, the processors may be configured to detect disengagement of the slips using a method for detecting connection make-up, such as that described previously in this disclosure, in combination with time-series block height data. Given the time-series block height data from a well operation, the steps in this method include the following:

1. Using a method described previously herein, or any other suitable method, identify a time interval over which the connection make-up step of the connection process occurred.
2. Record the block height at the end of the connection make-up step.
3. Beginning at the end of the connection make-up step, step forward through the time-series block height data. At each point in time, calculate the absolute difference between the measured block height and the block height at the end of the connection make-up step. If the absolute difference exceeds a specified tolerance, begin searching for the disengagement of the slips:
   Beginning at the point in time at which the absolute difference exceeded the specified tolerance, step backwards through the block height data. The disengagement of the slips corresponds to the last point in time at which the travelling block was stationary.

This method relies on the fact that significant motion of the travelling block is not possible after the tubular element in the derrick has been connected to the tubular string unless the slips are disengaged. Testing has indicated that a value of 0.1 metres (4 inches) is typically suitable for the specified tolerance used to identify the point in time at which the slips were disengaged. However, the optimal value for the specified tolerance can vary depending on rig equipment and operating procedures.

Method Combinations

Figure 14:
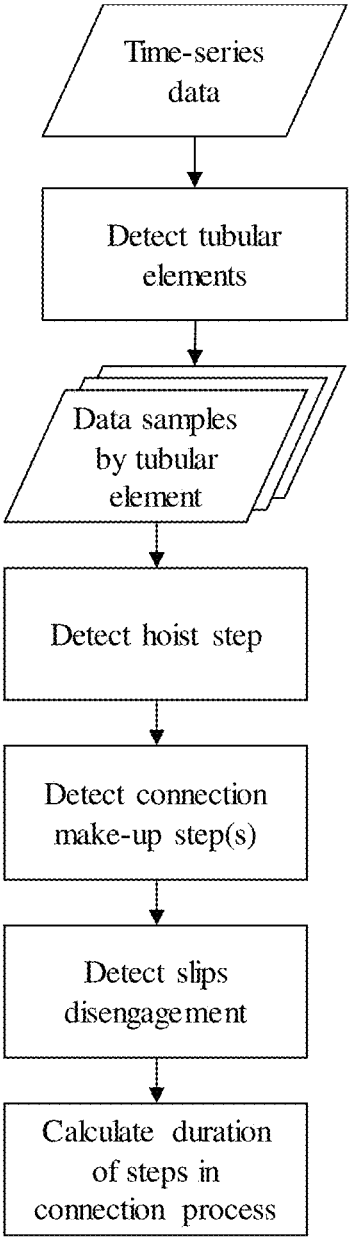
FIG. 14 is a flow chart schematically illustrating method steps employed by one embodiment of a system to calculate the duration of the steps in the connection process.

Systems in accordance with the present disclosure may use embodiments of methods described herein either individually or in combination. FIG. 14 is a flow chart schematically illustrating methods employed by one embodiment of a system to calculate the duration of steps in the connection process for a well operation in which a tubular string is run into a well. The system includes sensors that provide time-series measurements indicative of the block height, the rotation rate of the tubular element involved in the connection process, and the torque applied to the tubular element involved in the connection process. Using the method described previously, the system detects the transitions between tubular elements and divides the time-series data from the well operation into numerous data samples. Each data sample is then analyzed using the methods already described to detect the hoist and connection make-up steps of the connection process, as well as the disengagement of the slips. Finally, the duration of each step in the connection process is calculated for each tubular element.

Extensions to Systems and Methods Described Herein

The preceding discussion has been focused on well operations typically performed by drilling rigs. However, systems and methods in accordance with the present disclosure are adaptable for use in any operation in a wellbore involving segmented pipe with threaded connections. The disclosed systems and methods can be applied to operations performed by a drilling rig, a service rig, or any other type of rig.

It will be readily appreciated by those skilled in the art that various modifications to embodiments in accordance with the present disclosure may be devised without departing from the present teachings, including modifications which may use structures or materials later conceived or developed. It is to be especially understood that the scope of the present disclosure should not be limited by or to any particular embodiments described, illustrated, and/or claimed herein, but should be given the broadest interpretation consistent with the disclosure as a whole. It is also to be understood that the substitution of a variant of a claimed element or feature, without any substantial resultant change in functionality, will not constitute a departure from the scope of the disclosure or claims.

In this patent document, any form of the word "comprise" is intended to be understood in a non-limiting sense, meaning that any element or feature following such word is included, but elements or features not specifically mentioned are not excluded. A reference to an element or feature by the indefinite article "a" does not exclude the possibility that more than one such element or feature is present, unless the context clearly requires that there be one and only one such element.

Any use of any form of any term describing an interaction between elements or features is not meant to limit the interaction to direct interaction between the elements or features in question, but may also extend to indirect interaction between the elements such as through secondary or intermediary structure.

Any use herein of any form of the term "typical" is to be interpreted in the sense of being representative of common usage or practice, and is not to be interpreted as implying essentiality or invariability.

What is claimed is:

1. A method for detecting the occurrence of a selected connection process step in a well operation involving manipulation of a string of tubular elements by a drilling rig incorporating a travelling block, wherein the selected connection process step is selected from the group consisting of connection make-up steps and connection break-out steps, said method comprising the steps of:

(a) obtaining time-series measurements indicative of one or both of a rotation rate applied by the drilling rig and a torque applied by the drilling rig;
(b) selecting one or more time intervals within a selected time range spanned by the time-series measurements;
(c) for each selected time interval, calculating the value of an error function based on the time-series measurements obtained within that time interval; and
(d) designating a first one of the one or more selected time intervals as corresponding to the selected connection process step according to whether the value of the error function in respect of the first one of the one or more selected time intervals satisfies one or more specified criteria.

2. A method as in claim 1 wherein the error function is defined such that a lower error function value indicates a higher degree of correspondence between the first one of the one or more selected time intervals and the selected connection process step.

3. A method as in claim 2 wherein the one or more specified criteria include whether the value of the error function in respect of the first one of the one or more selected time intervals is less than or equal to a specified maximum value.

4. A method as in claim 1 wherein:

(a) the time-series measurements include time-series measurements indicative of a rotation rate applied by the drilling rig; and (b) the one or more time intervals are selected to span sequential combinations of rotation events.

5. A method as in claim 1 wherein the time-series measurements include time-series measurements indicative of a rotation rate applied by the drilling rig, and wherein the calculation of the error function value uses one or more inputs selected from the group consisting of:

(a) a number of rotations made by a specific tubular element selected from the string of tubular elements; and (b) a total duration of interruptions with respect to the rotation rate applied by the drilling rig.

6. A method as in claim 1 further comprising the step of isolating the time-series measurements corresponding to a specific tubular element selected from the string of tubular elements before selecting the one or more time intervals.

7. A method as in claim 6 further comprising the step of obtaining time-series measurements indicative of a travelling block height, and wherein the steps used to isolate the time-series measurements corresponding to the specific tubular element include:

(a) multiplying the travelling block height by negative one to obtain a negated travelling block height;

(b) specifying a prominence threshold value; and (c) identifying peaks in the negated travelling block height having prominences exceeding the prominence threshold value as corresponding to transitions between tubular elements of the string of tubular elements.

8. A method as in claim 7 wherein the prominence threshold value is selected to correspond to the length of a shortest tubular element of the string of tubular elements.

9. A method as in claim 1 wherein the selected connection process step is a connection make-up step, and further comprising the steps of:

(a) obtaining time-series measurements indicative of a travelling block height;

(b) designating the travelling block height at the end of the time interval identified as corresponding to the selected connection process step as a travelling block height reference datum; and (c) evaluating whether a change in slips state has occurred at a given point in time following the time interval identified as corresponding to the selected connection process step based on the difference between the travelling block height at the given point in time and the travelling block height reference datum.

10. A method as in claim 1 wherein the time-series measurements include time-series measurements indicative of a torque applied by the drilling rig, and wherein the calculation of the error function value uses one or more inputs selected from the group consisting of:

(a) a peak value of the torque applied by the drilling rig;

(b) an elapsed time until the occurrence of a peak value of the torque applied by the drilling rig; and (c) a total duration of interruptions with respect to the torque applied by the drilling rig.

11. A method as in claim 1, further comprising the step of obtaining time-series measurements indicative of a travelling block height, and wherein the calculation of the error function value uses a distance travelled by the travelling block as an input.

12. A method for detecting transitions between tubular elements of a string of tubular elements in a well operation involving manipulation of the string of tubular elements by a drilling rig incorporating a travelling block, said method comprising the steps of:

(a) obtaining time-series measurements indicative of a travelling block height;

(b) multiplying the travelling block height by negative one to obtain a negated travelling block height;

(c) specifying a prominence threshold value; and (d) identifying peaks in the negated travelling block height having prominences exceeding the prominence threshold value as corresponding to transitions between tubular elements of the string of tubular elements.

13. A method as in claim 12 wherein the prominence threshold value is selected to correspond to the length of a shortest tubular element of the string of tubular elements.

14. A method for detecting a selected connection process step in a well operation involving manipulation of a string of tubular elements by a drilling rig incorporating a travelling block, wherein the selected connection process step is selected from the group consisting of hoist steps and lowering steps, said method comprising the steps of:

(a) obtaining time-series measurements indicative of a travelling block height;

(b) isolating the time-series measurements corresponding to a specific tubular element selected from the string of tubular elements;

(c) determining a minimum travelling block height value and a maximum travelling block height value;

(d) specifying a first tolerance value and a second tolerance value;

(e) defining a first reference value as being equal to the minimum travelling block height value if the selected connection process step is a hoist step, or as being equal to the maximum travelling block height value if the selected connection process step is a lowering step;

(f) calculating as a function of time the absolute difference between the travelling block height and the first reference value;

(g) detecting the start time of the selected connection process step based on the condition that the absolute difference calculated in step (f) is greater than the first tolerance value;

(h) defining a second reference value as being equal to the maximum travelling block height value if the selected connection process step is a hoist step, or as being equal to the minimum travelling block height value if the selected connection process step is a lowering step;

(i) calculating as a function of time the absolute difference between the travelling block height and the second reference value; and (j) detecting the end time of the selected connection process step based on the condition that the absolute difference calculated in step (i) is less than the second tolerance value.

15. A method as in claim 14 wherein the first tolerance value and the second tolerance value are equal.

16. A method as in claim 14 wherein the step of detecting the start time of the selected connection process step comprises the steps of:

(a) beginning at the first point in time at which the absolute difference between the travelling block height and the first reference value is greater than the first tolerance value, stepping backwards through the time-series measurements; and (b) designating the last point in time at which the travelling block was stationary or changed direction as the start time of the selected connection process step.

17. A method as in claim 14 wherein the step of detecting the end time of the selected connection process step comprises the steps of:

(a) beginning at the first point in time at which the absolute difference between the travelling block height and the second reference value is less than the second tolerance value, stepping forward through the time-series measurements; and (b) designating the next point in time at which the travelling block was stationary or changed direction as the end time of the selected connection process step.

18. A method for detecting a change in slips state in a well operation involving manipulation of a string of tubular elements by a drilling rig incorporating a travelling block, said method comprising the steps of:

(a) obtaining time-series measurements indicative of a travelling block height;

(b) detecting a time interval corresponding to a connection make-up step;

(c) designating the travelling block height at the end of the time interval as a travelling block height reference datum; and (d) evaluating whether a change in slips state has occurred at a given point in time, based on the difference between the travelling block height at the given point in time and the travelling block height reference datum.

19. A method as in claim 18 wherein the step of evaluating whether a change in slips state has occurred comprises the steps of:

(a) beginning at the end time of the connection make-up step, stepping forward through the time-series measurements until the absolute difference between the travelling block height and the travelling block height reference datum exceeds a specified tolerance; and (b) then stepping backwards through the time-series measurements and designating the last point in time at which the travelling block was stationary as the point in time when the change in slips state occurred.

20. A system for detecting the occurrence of a selected connection process step in a well operation involving manipulation of a string of tubular elements by a drilling rig incorporating a travelling block, wherein the selected connection process step is selected from the group consisting of connection make-up steps and connection break-out steps, said system comprising:

(a) one or more sensors configured to obtain time-series measurements including time-series measurements indicative of one or both of a rotation rate applied by the drilling rig and a torque applied by the drilling rig; and (b) one or more processors configured to receive the time-series measurements from the one or more sensors and to perform the steps of:

(b.1) selecting one or more time intervals within a selected time range spanned by the time-series measurements;

(b.2) for each selected time interval, calculating the value of an error function based on the time-series measurements obtained within that time interval; and (b.3) designating a first one of the one or more selected time intervals as corresponding to the selected connection process step according to whether the value of the error function in respect of the first one of the one or more selected time intervals satisfies one or more specified criteria.

21. A system as in claim 20 wherein:

(a) the time-series measurements that the one or more sensors are configured to obtain include time-series measurements indicative of a rotation rate applied by the drilling rig; and (b) the one or more processors are configured to select the one or more time intervals to span sequential combinations of rotation events.

22. A system as in claim 20 wherein the time-series measurements that the one or more sensors are configured to obtain include time-series measurements indicative of a rotation rate applied by the drilling rig, and wherein the one or more processors are configured to calculate the error function value using one or more inputs selected from the group consisting of:

(a) a number of rotations made by a specific tubular element selected from the string of tubular elements; and (b) a total duration of interruptions with respect to the rotation rate applied by the drilling rig.

23. A system as in claim 20 wherein the one or more processors are further configured to perform the step of isolating the time-series measurements corresponding to a specific tubular element selected from the string of tubular elements before selecting the one or more time intervals.

24. A system as in claim 23 wherein the time-series measurements that the one or more sensors are configured to obtain include time-series measurements indicative of a travelling block height, and wherein the steps used by the one or more processors to isolate the time-series measurements corresponding to the specific tubular element include:

(a) multiplying the travelling block height by negative one to obtain a negated travelling block height; and (b) identifying peaks in the negated travelling block height having prominences exceeding a specified prominence threshold value as corresponding to transitions between tubular elements of the string of tubular elements.

25. A system as in claim 24 wherein the specified prominence threshold value is selected to correspond to the length of a shortest tubular element of the string of tubular elements.

26. A system as in claim 20 wherein the time-series measurements that the one or more sensors are configured to obtain include measurements indicative of a travelling block height, wherein the selected connection process step is a connection make-up step, and wherein the one or more processors are further configured to perform the steps of:

(a) designating the travelling block height at the end of the time interval identified as corresponding to the selected connection process step as a travelling block height reference datum; and (b) evaluating whether a change in slips state has occurred at a given point in time following the time interval identified as corresponding to the selected connection process step based on the difference between the travelling block height at the given point in time and the travelling block height reference datum.

27. A system as in claim 20 wherein the error function is defined such that a lower error function value indicates a higher degree of correspondence between the first one of the one or more selected time intervals and the selected connection process step.

28. A system as in claim 27 wherein the one or more specified criteria include whether the value of the error function in respect of the first one of the one or more selected time intervals is less than or equal to a specified maximum value.

29. A system as in claim 20 wherein the time-series measurements that the one or more sensors are configured to obtain include time-series measurements indicative of a torque applied by the drilling rig, and wherein the one or more processors are configured to calculate the error function value using one or more inputs selected from the group consisting of:

(a) a peak value of the torque applied by the drilling rig;

(b) an elapsed time until the occurrence of a peak value of the torque applied by the drilling rig; and (c) a total duration of interruptions with respect to the torque applied by the drilling rig.

30. A system as in claim 20 wherein the time-series measurements that the one or more sensors are configured to obtain include time-series measurements indicative of a travelling block height, and wherein the one or more processors are configured to calculate the error function value using a distance travelled by the travelling block as an input.

31. A system for detecting transitions between tubular elements of a string of tubular elements in a well operation involving manipulation of the string of tubular elements by a drilling rig incorporating a travelling block, said system comprising:

(a) one or more sensors configured to obtain time-series measurements including time-series measurements indicative of a travelling block height; and (b) one or more processors configured to receive the time-series measurements from the one or more sensors and to perform the steps of:

(b.1) multiplying the travelling block height by negative one to obtain a negated travelling block height; and (b.2) identifying peaks in the negated travelling block height with prominences exceeding a specified prominence threshold value as corresponding to transitions between tubular elements of the string of tubular elements.

32. A system as in claim 31 wherein the specified prominence threshold value is selected to correspond to the length of a shortest tubular element of the string of tubular elements.

33. A system for detecting a selected connection process step in a well operation involving manipulation of a string of tubular elements by a drilling rig incorporating a travelling block, wherein the selected connection process step is selected from the group consisting of hoist steps and lowering steps, said system comprising:

(a) one or more sensors configured to obtain time-series measurements indicative of a travelling block height; and (b) one or more processors configured to receive the time-series measurements from the one or more sensors and to perform the steps of:

(b.1) isolating the time-series measurements corresponding to a specific tubular element selected from the string of tubular elements;

(b.2) determining a minimum travelling block height value and a maximum travelling block height value;

(b.3) defining a first reference value as being equal to the minimum travelling block height value if the selected connection process step is a hoist step, or as being equal to the maximum travelling block height value if the selected connection process step is a lowering step;

(b.4) calculating as a function of time the absolute difference between the travelling block height and the first reference value;

(b.5) detecting the start time of the selected connection process step based on the condition that the absolute difference calculated in in step (b.4) is greater than a first specified tolerance value;

(b.6) defining a second reference value as being equal to the maximum travelling block height value if the selected connection process step is a hoist step, or as being equal to the minimum travelling block height value if the selected connection process step is a lowering step;

(b.7) calculating as a function of time the absolute difference between the travelling block height and the second reference value; and (b.8) detecting the end time of the selected connection process step based on the condition that the absolute difference calculated in in step (b.7) is less than a second specified tolerance value.

34. A system as in claim 33 wherein the first specified tolerance value and the second specified tolerance value are equal.

35. A system as in claim 33 wherein the step of detecting the start time of the selected connection process step comprises the steps of:

(a) beginning at the first point in time at which the absolute difference between the travelling block height and the first reference value is greater than the first tolerance value, stepping backwards through the time-series measurements; and (b) designating the last point in time at which the travelling block was stationary or changed direction as the start time of the selected connection process step.

36. A system as in claim 33 wherein the step of detecting the end time of the selected connection process step comprises the steps of:

(a) beginning at the first point in time at which the absolute difference between the travelling block height and the second reference value is less than the second tolerance value, stepping forward through the time-series measurements; and (b) designating the next point in time at which the travelling block was stationary or changed direction as the end time of the selected connection process step.

37. A system for detecting a change in slips state in a well operation involving manipulation of a string of tubular elements by a drilling rig incorporating a travelling block, said system comprising:

(a) one or more sensors configured to obtain time-series measurements including time-series measurements indicative of a travelling block height; and (b) one or more processors configured to receive the time-series measurements from the one or more sensors and to perform the steps of:

(b.1) detecting a time interval corresponding to a connection make-up step;

(b.2) designating the travelling block height at the end of the time interval as a travelling block height reference datum; and (b.3) evaluating whether a change in slips state has occurred at a given point in time based on the difference between the travelling block height at the given point in time and the travelling block height reference datum.

38. A system as in claim 37 wherein the step of evaluating whether a change in slips state has occurred comprises the steps of:

(a) beginning at the end time of the connection make-up step, stepping forward through the time-series measurements until the absolute difference between the travelling block height and the travelling block height reference datum exceeds a specified tolerance; and (b) then stepping backwards through the time-series measurements and designating the last point in time at which the travelling block was stationary as the point in time when the change in slips state occurred.

* * * * *